US005795090A

United States Patent [19]

Jackson

[11] Patent Number: 5,795,090

[45] Date of Patent: Aug. 18, 1998

[54] PHOTOGRAPH LOG

[76] Inventor: Jenny Jackson, 4613 Framington Ct., Indianapolis, Ind. 46254

[21] Appl. No.: 726,537

[22] Filed: Oct. 7, 1996

[51] Int. Cl.[6] ..... B42F 13/00

[52] U.S. Cl. ..... 402/79; 402/80 R; 283/101; 281/38

[58] Field of Search ..... 402/79, 80 R; 281/38, 51; 283/81, 101, 100, 61

[56] References Cited

U.S. PATENT DOCUMENTS

| | | | |
|---|---|---|---|
| D. 321,007 | 10/1991 | Barrick | D19/33 |
| 3,946,507 | 3/1976 | Fergg et al. | 40/2 |
| 4,971,364 | 11/1990 | Templet | 283/70 |
| 5,143,466 | 9/1992 | Baldwin et al. | 402/79 |
| 5,329,713 | 7/1994 | Lundell | 40/310 |
| 5,351,813 | 10/1994 | Golovan | 206/45.34 |
| 5,431,449 | 7/1995 | Arimoto et al. | 281/31 |
| 5,459,826 | 10/1995 | Archibald | 395/147 |

*Primary Examiner*—Frances Han

[57] ABSTRACT

The present invention relates to a photograph log (10) which comprises at least one first page (12A). The photograph log (10) further comprises a plurality of first photograph log labels (14A) which comprise a non-permanent adhesive on a first photograph log label under side (14AD). The plurality of first photograph log labels (14A) are each removably attached to the at least one first page (12A). Each first photograph log labels (14A) comprises a first photograph log label frame number (14AA) number indicia printed on a first photograph log label top side (14AE) which correlates to the camera film frame (16AA). Each first photograph log label (14A) further comprises a first photograph log label frame description (14AB) area printed on the first photograph log label top side (14AE) wherein an user writes information about the picture taken which correlates to the camera film frame (16AA). Each first photograph log label (14A) further comprises first photograph log label frame date (14AC) printed on the first photograph log label top side (14AE) wherein the user writes the date when the picture was taken.

6 Claims, 3 Drawing Sheets

PHOTOGRAPH LOG

BACKGROUND OF THE INVENTION

1. Field of the Invention

The present invention relates to a photograph log. More particularly, the present invention relates to a photograph log which has a plurality of removable labels on pages. Each page preferably has twelve labels thereon which correlates to the number of camera film frames present on standard camera film. Each label has photograph log label frame number indicia printed thereon which corresponds to a film frame as well as a photograph log label frame description and a photograph log label frame date.

2. Description of the Prior Art

Adhesive labels which are removably attached to a page are well known in the art. The labels are utilized for affixing identification labels on items such as boxes, cans, bottles etc. However there exists a need for a simple to utilize photographic log on which a photographer can write a brief description of the picture taken as well as the date and the label itself has indicia thereon which correlates to the picture frame taken.

Numerous innovations for photograph logs have been provided in the prior art that are described as follows. Even though these innovations may be suitable for the specific individual purposes to which they address, they differ from the present invention as hereinafter contrasted.

In U.S. Pat. No. 5,459,826 titled System and method for preparing text and pictorial materials for printing using predetermined coding and merging regimen, invented by Delbert M. Archibald, a method and system for locally organizing and laying out text and pictorial material for a page to be printed at a remote facility provides a layout template having a fixed grid pattern, and plural layout elements which are organized across the grid pattern corresponding to the page to be printed. Each element contains an area for text or pictorial material. A predetermined code is assigned to each layout element, with regard to whether the element contains text, photographs, or both. A predetermined code is assigned to each layout element and represents the arean of the element with respect to the grid pattern of the template. A representation of the organized layout elements is generated and transmitted to the remote facility, where the pictorial and text elements are correlated and merged together to provide an output data stream representative of the page to be printed.

The patented invention differs from the present invention because the patented invention is a method for organizing photos at one site that will be placed on a page layout developed at a second site prior to printing the page. The present invention is a book of labels on which data may be recorded pertinent to the photo taken. Later the labels are affixed to the back of the developed photos or placed near the photo in an album.

In U.S. Pat. No. 5,431,449, titled Film storing sheet, invented by Keigo Arimoto and Toru Tanibata, a film storing sheet comprising: an index print on which recorded images on a developed film is printed and a film sheet provided at the rear side of the index print and having a plurality of small pockets wherein the developed film is stored. Users can easily distinguish specific prints by seeing the index print.

The patented invention differs from the present invention because the patented invention is a storage means for negatives comprising a transparent pocket to hold an index print and a number of transparent pockets to hold individual negative strips. The present invention is a book of removable adhesive labels on which data may be recorded pertinent to the photo taken. Later the labels are peeled out of the book then affixed to the back of the developed photos or placed near the photo in an album.

In U.S. Pat. No. 5,351,813, titled Display and storage apparatus, invented by Bruce Golovan, a holding apparatus for holding relatively small items comprised of a generally flexible planar base, attachment means for attaching the base to a vertical surface such as a refrigerator door or the like, at least one storage and/or display compartment, and at least one fastener for releasably attaching the compartments to the base. The holding and/or display apparatus allows an user to detach and carry along the detachable compartment to a desired destination. In addition, the apparatus may be utilized for organizing and/or visibly displaying relatively light weight and thin materials such as appointment cards, theatrical tickets, photographs, sketches, etc. without puncturing or affecting the integrity of the material.

The patented invention differs from the present invention because the patented invention is a storage means for small articles comprising a number of transparent removable pockets. The present invention is a book of adhesive labels on which data may be recorded pertinent to the photo taken. Later the labels are peeled out of the book then affixed to the back of the developed photos or placed near the photo in an album.

In U.S. Pat. No. 5,329,713, titled Label with removable part, invented by Peter Lundell, a container label comprises a main portion bearing generic identification indicia, an adhesive or the like for permanently securing the main portion to a container, a secondary portion bearing specific identification indicia, and an integral but destructible connection web between the main portion and the secondary portion. The secondary portion is itself free of securing means so that the secondary portion can be separated from the main portion by destruction of the web.

The patented invention differs from the present invention because the patented invention is an inventory control system typically for use when dispensing controlled substances. The present invention is a book of adhesive labels on which data may be recorded pertinent to the photo taken. Later the labels are peeled out of the book then affixed to the back of the developed photos or placed near the photo in an album.

In U.S. Pat. No. 3,946,507, titled Label for Use on Containers for Photographic Film or the like, invented by Berthold Fergg, Wolfgang Zahn, and Friedrich Hujer, a rectangular label wherein a rectangular central portion is disposed between two rectangular sections having their rear sides provided with coats of adhesive. The front side of the central label portion bears imprinted information pertaining to the cost of developing of photographic film, the number of prints to be made from film, the price per print, the nature of film and/or the size of each print. The adhesive-coated sections are partially separated from the central portion by rows of perforations so that the central portion can be completely separated from the sections while the sections adhere to an envelope in order to at least partially close an open end of the envelope. Additional information may be imprinted onto the front side of at least one section to remain on the envelope, either as a bill to the dealer or as a bill to the customer. At least one of the adhesive-coated sections is provided with a fold line so that it can be readily folded over the open end of an envelope.

The patented invention differs from the present invention because the patented invention is a control system typically for use when it is necessary to match one item with another such as a roll of film with an envelope containing the photos and negatives. It is a label which can be separated with each section used on multiple items while retaining traceability to the original source. The present invention is a book of adhesive labels on which data may be recorded pertinent to the photo taken. Later the labels are peeled out of the book then affixed to the back of the developed photos or placed near the photo in an album.

In U.S. Pat. No. Des. 321,007, titled Photograph Negative Organizer is an ornamental design for a photographic negative organizer having multiple envelopes for storage of negatives. The patented invention does not have any features similar to the present invention.

Numerous innovations for photograph logs have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a photograph log. More particularly, the present invention relates to a photograph log which has a plurality of removable labels on pages. Each page preferably has twelve labels thereon which correlates to the number of camera film frames present on standard camera film. Each label has photograph log label frame number indicia printed thereon which corresponds to a film frame as well as a photograph log label frame description and a photograph log label frame date.

The present invention is a pocket-size spiral-bound notebook that is used by the photographers (or tourists) to document what is represented in each picture, and the date taken. Description may be of a place, an event, people's names, or an interesting fact; 2 lines are allowed for each description. Each roll of film is labeled with a letter starting with "A". Each picture frame is represented by that corresponding number. In the present invention, "A1" would correspond to the first picture taken on roll "A" film. The notebook consists of 3 pages per roll (12 numbers to a page) and would accommodate 5 or 10 rolls (2 different sizes). Each description is a peel-off strip label that can be used later, to label each picture after it is developed. This eliminates having to write out descriptions of pictures 2 times and provides an easy way to keep track of everything. Could also make one for advanced professional photographers that includes film speed, aperture, and shutter speed spaces. The present invention could also be manufactured in perforated cardboard strip labels that could be torn apart and placed beside each picture in a photo album.

The types of problems encountered in the prior art are after a picture is taken and as time elapses the person forgets where and when the picture was taken as well as other pertinent information.

In the prior art, unsuccessful attempts to solve this problem were attempted namely: film negative holders with labels attached thereto. However, the problem was solved by the present invention because it allows the photographer to record data on an adhesive label at the time of the photo shot and then affix the label to the photo when the negatives are developed.

Innovations within the prior art are rapidly being exploited in the field of photography.

The present invention went contrary to the teaching of the art which teaches holders for negatives and/or photographs which have corresponding labels.

The present invention solved a long felt need for a simple and rapid photograph/film negative identification means.

Accordingly, it is an object of the present invention to provide a photograph log.

More particularly, it is an object of the present invention to provide a photograph log having a plurality of pages affixed to one another by a page binder.

In keeping with these objects, and with others which will become apparent hereinafter, one feature of the present invention resides, briefly stated, in each page having a plurality of photograph log labels.

When the photograph log labels are designed in accordance with the present invention, each has a photograph log label frame number, a photograph log label frame description, and a photograph log label frame date printed on a photograph log label top side.

In accordance with another feature of the present invention, each of the photograph log labels has a non-permanent adhesive photograph log label under side.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—photograph log (10)
12A—first page (12A)
12B—second page (12B)
12C—third page (12C)
12D—page binder (12D)
14A—first photograph log label (14A)
014AA—first photograph log label frame number (14AA)
14AB—first photograph log label frame description (14AB)
14AC—first photograph log label frame date (14AC)
16—camera (16)
16A—camera film (16A) (not shown)
16AA—camera film frame (16AA) (not shown)
18A—first person (18A)
18B—second person (18B)

DESCRIPTION OF THE PREFERRED EMBODIMENT

Figure 1:
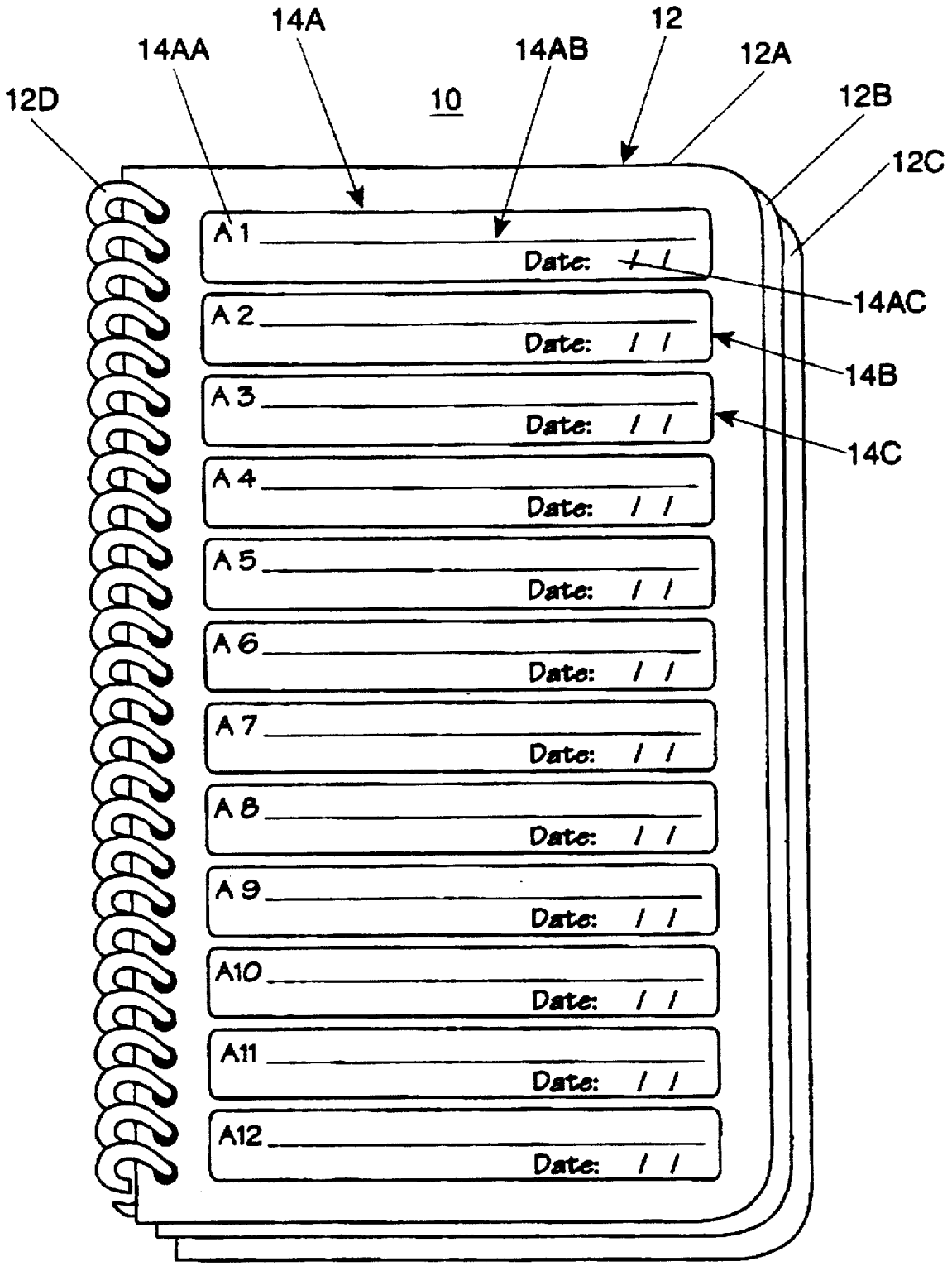
FIG. 1 is a front perspective view of a photograph log exhibiting a plurality of pages affixed to each other by a page binder wherein each page having a plurality of photograph log label removably attached thereon.
Figure 2:
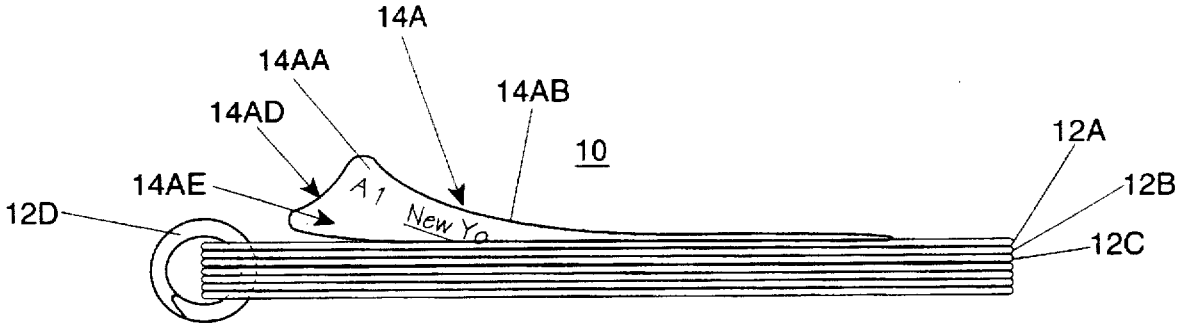
FIG. 2 is a side view of a photograph log exhibiting a plurality of pages affixed to each other by a page binder wherein a photograph log label is being removably detached from a page.

Firstly, referring to FIG. 1 and FIG. 2 which show a front perspective view and a side view, having the following features: first page (12A) second page (12B), third page (12C), page binder (12D), first photograph log label (14A), first photograph log label frame number (14AA), first photograph log label frame description (14AB), first photograph log label frame date (14AC), first photograph log label under side (14AD), first photograph log label top side (14AE), camera (16), camera film (16A) (not shown), and camera film frame (16AA) (not shown).

A photograph log (10) comprises a plurality of first pages (12A), second pages (12B), and third pages (12C) affixed to each other by a page binder (12D). The plurality of pages (12A, 12B, and 12C) each has a plurality of first photograph log labels (14A) removably attached thereon. The photograph log (10) functions to permit an user to record information about each camera film frame (16AA) taken by a camera (16).

The plurality of first photograph log labels (14A) comprise a non-permanent adhesive on a first photograph log label under side (14AD). The plurality of first photograph log labels (14A) are each removably attached the plurality of first page (12A). The plurality of first page (12A) further comprises a first photograph log label frame number (14AA) indicia printed on a first photograph log label top side (14AE) which correlates to the camera film frame (16AA). The plurality of first photograph log labels (14A) has a first photograph log label frame description (14AB) area printed on the first photograph log label top side (14AE) wherein an user writes information about the picture taken which correlates to the camera film frame (16AA).The plurality of first photograph log labels (14A) has first photograph log label frame date (14AC) printed on the first photograph log label top side (14AE) wherein the user writes the date when the picture was taken.

The at least one page is preferably in three page groups consisting of first page (12A), second page (12B), and third page (12C). The three pages are affixed to each other by a page binder (12D). The at least one page is manufactured from a material selected from a group consisting of paper, plastic and plastic composite. The preferred material is plastic and plastic composite which have a releasable top surface upon which the photograph log labels are removably attached.

The plurality of first pages (12A), second pages (12B), and third pages (12C) are preferably twelve photograph log labels per page which functions to correlate to the number of camera film frame (16AA) present in standard camera film (16A). The plurality of first photograph log labels (14A) are manufactured of a material selected from a group consisting of paper, plastic and plastic composite. The preferred material is plastic or plastic composite having a surface which is easily writeable upon. The plurality of at least one first page (12A) are affixed to each other by a page binder (12D).

The plurality of first photograph log labels (14A) when manufactured from a hydrophobic material permit the photograph log (10) to be used under water.

Figure 3:
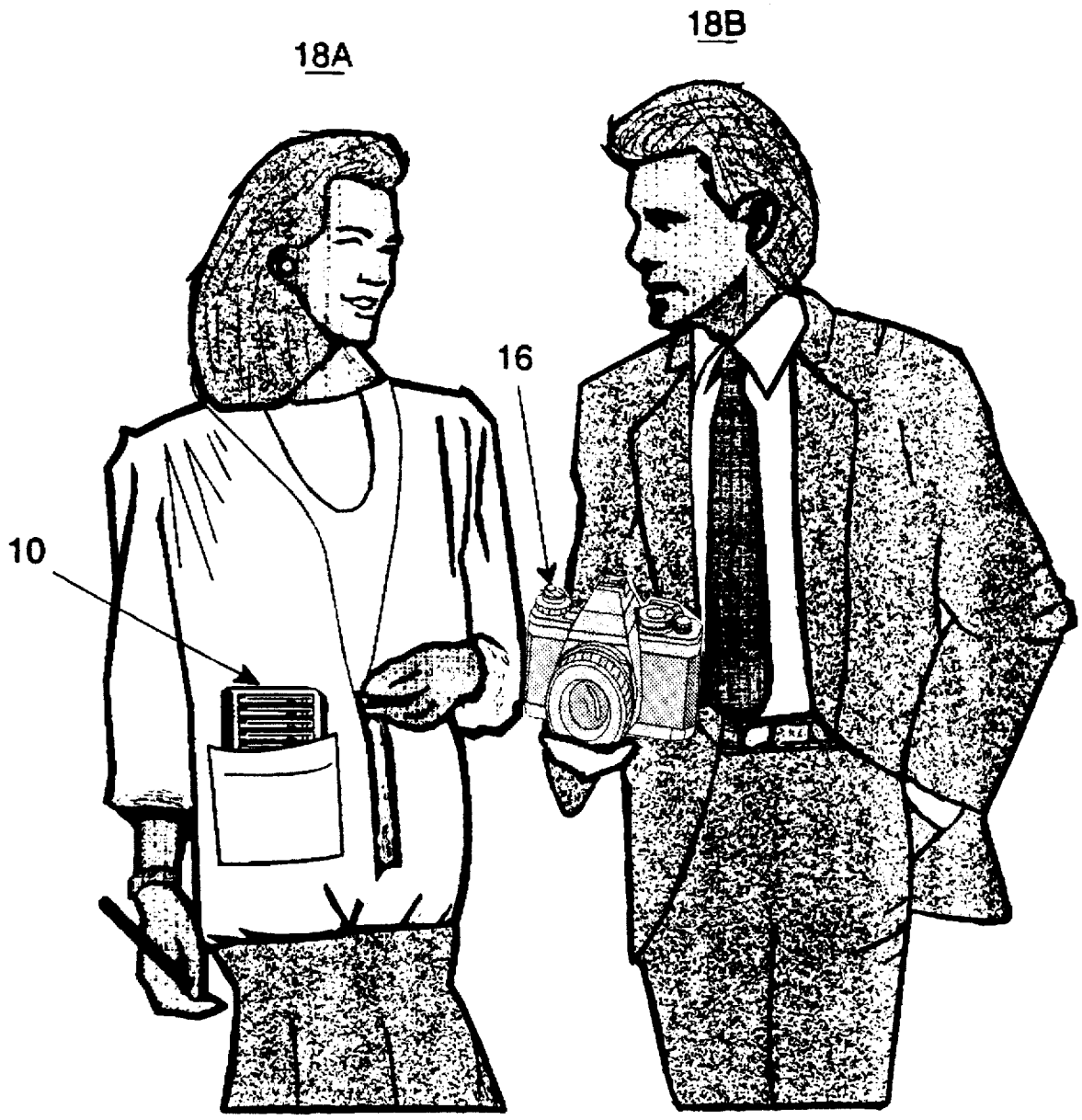
FIG. 3 is a perspective view of a photographer's assistant having a photograph log compactly and conveniently stored in her pocket ready to record the next picture that is taken and a photographer ready to take a picture from a camera.

Lastly, referring to FIG. 3 which is a perspective view of a photographer's assistant (18A) having a photograph log (10) compactly and conveniently stored in the photographer's assistant (18A) pocket ready to record the next camera film frame (16AA) (not shown) that is taken and a photographer (18B) ready to take a camera film frame (16AA) (not shown) from a camera (16). By employing the simple and easy to use photograph log (10), the photographer (18B) may eliminate a photographer's assistant (18A) thus reducing overall cost of a photography session.

It will be understood that each of the elements described above, or two or more together, may also find an useful application in other types of constructions differing from the type described above.

While the invention has been illustrated and described as embodied in a photograph log, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A photograph log (10) comprising:

A) at least one first page (12A);

B) a plurality of first photograph log labels (14A) which are each removably attached to the at least one first page (12A) by a non-permanent adhesive applied at a first photograph log label under side (14AD), the plurality of first photograph log labels (14A) comprises a first photograph log label frame number (14AA) indicia printed on a first photograph log label top side (14AE) which correlates to the camera film frame (16AA), each plurality of first photograph log labels (14A) further comprises a first photograph log label frame description (14AB) area printed on the first photograph log label top side (14AE) wherein an user writes information about the picture taken which correlates to the camera film frame (16AA), each plurality of first photograph log label (14A) consists of a first photograph log label frame date (14AC) printed on the first photograph log label top side (14AE) wherein the user writes the date when the picture was taken; the plurality of first photograph log label (14A) functions to record information about each camera film frame (16AA) taken by a camera (16).

2. The photograph log (10) as described in claim 1, wherein the at least one first page (12A) is a plurality of first pages (12A) which are affixed to each other by a page binder (12D).

3. The photograph log (10) as described in claim 1, wherein the at least one first page (12A) is manufactured of a material selected from a group consisting of paper, plastic and plastic composite.

4. The photograph log (10) as described in claim 1, wherein the plurality of first photograph log labels (14A) are assembled on the at least one first page (12A) in quantities corresponding to the number of camera film frames (16AA) present in standard camera film (16A).

5. The photograph log (10) as described in claim 4, wherein the plurality of plurality of first photograph log labels (14A) are manufactured from a material selected from a group consisting of paper, plastic, and plastic composite.

6. The photograph log (10) as described in claim 4, wherein the plurality of first photograph log labels (14A) are manufactured from a hydrophobic material with underwater writing capabilities.

* * * * *